United States Patent [19]

Raasch et al.

[11] Patent Number: 4,897,993

[45] Date of Patent: Feb. 6, 1990

[54] CLEANING DEVICE FOR OPEN END SPINNING ROTOR

[75] Inventors: Hans Raasch; Reinhard Böker, both of Monchen-Gladbach, Fed. Rep. of Germany

[73] Assignee: W. Schlafhorst & Co., Fed. Rep. of Germany

[21] Appl. No.: 193,356

[22] Filed: May 12, 1988

[30] Foreign Application Priority Data

May 13, 1987 [DE] Fed. Rep. of Germany ..... 3715934

[51] Int. Cl.[4] ..... D01H 11/00

[52] U.S. Cl. ..... 57/302

[58] Field of Search ..... 57/301, 302, 304

[56] References Cited

U.S. PATENT DOCUMENTS 3,524,312 8/1970 Landwehrkamp et al. ..... 57/302
3,597,911 8/1971 Rieter ..... 57/264 X
3,869,851 3/1975 Muller ..... 57/302
4,057,955 11/1977 Roehrich ..... 57/302
4,125,991 11/1978 Stahlecker ..... 57/302

FOREIGN PATENT DOCUMENTS 2618094 11/1977 Fed. Rep. of Germany .

*Primary Examiner*—Donald Watkins
*Attorney, Agent, or Firm*—Shefte, Pinckney & Sawyer

[57] ABSTRACT

A cleaning device for removing debris from the fiber collection groove of an open end spinning rotor utilizes a holder having a rounded end portion and a scraper component having a tubular foot portion mounted thereabout for pivotal movement with respect thereto. A leaf spring attached to the holder retains the scraper component in attachment with the holder and is selectively disengagable for removal and replacement of the scaper component and end portion of the scraper component is bent oppositely to the direction of rotation of the rotor for engagement in the rotor groove to break up and scrape out accumulated debris deposits therein.

5 Claims, 1 Drawing Sheet

CLEANING DEVICE FOR OPEN END SPINNING ROTOR

BACKGROUND OF THE INVENTION

The present invention relates to a cleaning device utilizing a scraper component insertable into the fiber collection groove in a spinning rotor of an open end spinning machine for removing debris from the fiber collection groove.

West German Patentschrift DE-PS 26 29 161 discloses a maintenance device for an open end spinning rotor utilizing spring-retained cleaning elements which are insertable into the spinning rotor and rotatable to move under the prevailing centrifugal forces of such rotation against the retaining springs to engage the bottom wall and collection groove within the rotor interior for cleaning such rotor surfaces.

As is known, some open end spinning rotors include a very sharp and narrow fiber collection groove in order to spin relatively fine yarns according to the open end rotor spinning method. Further, the diameter of conventional open end spinning rotors has been reduced from earlier rotors, for example to a size of approximately 30 millimeters measured within the fiber collection groove. Given the narrow configuration and small diameter of the fiber collection groove in such spinning rotors, it is difficult to remove fine dust and husk particles which tend to deposit in the fiber collection groove. The removal of this debris is made even more difficult by the high rotational speeds at which such rotors are conventionally operated, the centrifugal forces thereby produced causing the debris particles to be pressed into the rotor groove and the greater heat produced by such higher speeds causing the debris particles to essentially become baked within the groove.

Since the cleaning elements of the known maintenance device mentioned above as disclosed in West German Patentschrift DE-PS 26 29 161 are spring biased, any scraping component utilized in such maintenance device tends to slide over hardened deposits of debris within the fiber collection groove without removing them. As a result, the cleaning operation of such maintenance device is incomplete and further causes premature wearing of the cleaning elements.

SUMMARY OF THE INVENTION

It is accordingly an object of the present invention to provide a cleaning device for an open end spinning rotor which is effective to fully clean the fiber collection groove of the rotor.

Briefly summarized, the cleaning device of the present invention includes a scraper component adapted for insertion into the fiber collection groove of the spinning rotor to engage and remove debris deposits therefrom. According to one feature of the present invention, the scraper component is provided with an end portion which is bent to extend oppositely to the direction of rotation of the rotor with the end portion presenting a forward edge inclined with respect to the rotational direction of the rotor.

This construction enables the end portion of the scraper component to penetrate beneath and break loose even hardened, baked-on debris deposits within the fiber collection groove of a spinning rotor. The bent configuration of the end portion of the scraper component further makes it possible to tolerate a certain degree of wear between the scraper component and the fiber collection groove so long as the bent orientation of the end portion remains opposite to the direction of rotor rotation.

According to another feature of the present invention, the cleaning device is provided with a holder having a rounded end portion and the scraper component is provided with a tubular foot portion for encircling mounting on the rounded end portion of the holder for pivotal movement relative thereto. The holder is preferably movable toward and away from the fiber collection groove of the rotor to enable corresponding movement of the scraper component into and out of the fiber collection groove. A leaf spring is attached to the holder with the leaf spring and the scraper component having compatible detent portions selectively engagable for retaining the scraper component in attachment with the holder and disengagable for removal and replacement of the scraper component.

As will be understood, the pivotability of the scraper component considerably simplifies its position in relation to a spinning rotor when introduced into the rotor for a cleaning operation. Cleaning devices of this type generally service a plurality of spinning units and therefore an exact positioning of the scraper component in relation to the fiber collection groove of the rotor at each spinning position is not possible. The pivotable mounting of the scraper component of the present invention enables the scraper component to initially strike the bottom interior wall of the rotor when the scraper component first enters the rotor and to then slide into the rotor groove, whereby proper positioning of the scraper component is achieved with each rotor to be cleaned.

Further, the manner of attachment of the scraper component to the holder of the cleaning device avoids the use of any permanent form of attachment, for example screws, so that rapid and simple removal and replacement of the scraper component may be carried out when necessary without the use of any tools. Instead, the leaf spring need only be lifted to disengage its detent portion from that of the holder to enable the foot portion of the scraper component to be readily disengaged from the rounded end portion of the holder. Moreover, the detent engagement between the scraper component and the holder prevents any lateral deflection of the scraper component when in operation within the fiber collection groove of a spinning rotor to insure effective cleaning.

DESCRIPTION OF THE PREFERRED EMBODIMENT

Figure 1:
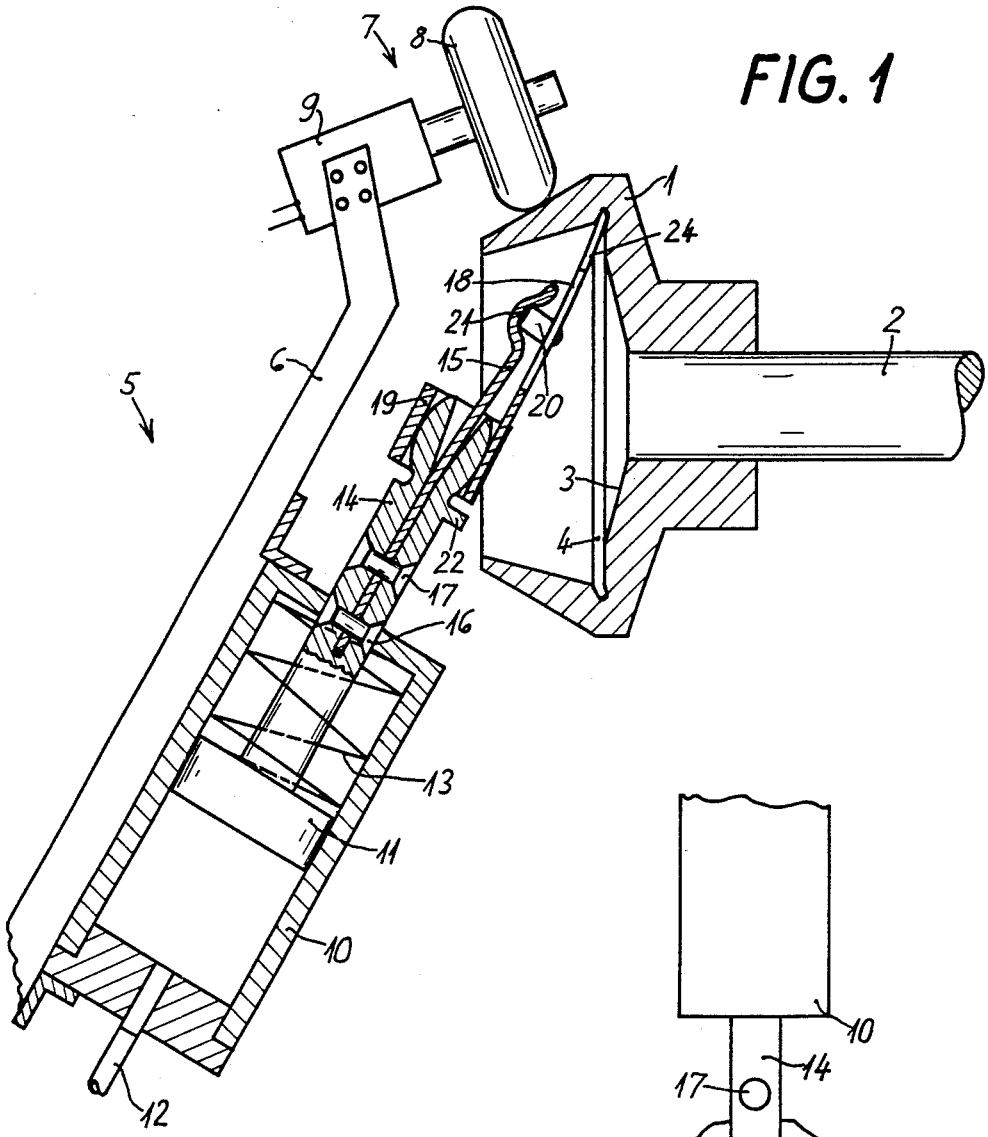
FIG. 1 is a side view, partially in cross-section, showing a cleaning device according to the preferred embodiment of the present invention in operation for cleaning the fiber collection groove of a spinning rotor.

Referring now to the accompanying drawings and initially to FIG. 1, an open end spinning rotor of a generally conventional type is representatively shown at 1 in axial cross-section as mounted on a rotor drive shaft 2 in an open end spinning unit not otherwise illustrated. The rotor 1 defines a yarn-forming interior having a bottom wall 3 and a continuous circular fiber collection groove 4 along the outer periphery of the bottom wall 3, which operates in conventional manner for yarn formation.

As aforementioned, maintenance devices having cleaning elements, such as scrapers, insertable into an open end spinning rotor for cleaning its interior yarn forming surfaces are known, such as disclosed in West German Patentschrift DE-PS 26 29 161 and other publications. The present invention constitutes an improvement of such prior art maintenance devices. The present cleaning device is indicated generally in FIG. 1 at 5 in cleaning disposition at the forwardly open side of the spinning rotor 1. The cleaning device 5 includes an arm 6 which is pivotably or otherwise movably mounted in a manner not shown for movement toward and away from the spinning rotor 1 into and out of the cleaning disposition shown. A drive arrangement, generally indicated at 7, is provided at the outward free end of the arm 6 and preferably includes a friction wheel 8 driven by an electric motor 9. The friction wheel 8 is adapted to peripherally engage the exterior circumference of the spinning rotor 1 for driven operation thereof when the cleaning device 5 is in its cleaning disposition as shown, the rotor 1 being separated from its normal operational drive during cleaning operation.

A cylinder 10 is mounted to the arm 6 of the cleaning device 5. A piston 11 having a holder shaft portion 14 is reciprocably disposed within the cylinder 10 with the holder shaft 14 extending outwardly through one end wall of the cylinder 10 toward the spinning rotor 1. A supply line 12 to a source of compressed air is fitted in an opening in the opposite end wall of the cylinder 10 for admitting compressed air to move the piston 11 to extend the holder shaft 14 in the direction of the spinning rotor 1. A spring 13 is disposed within the cylinder 10 on the opposite side of the piston 11 to bias the piston 11 in the opposite direction for retraction of the holder shaft 14. The outwardly projecting free end of the holder shaft 14 is formed of a bulbous rounded ball-like shape. Additionally, the holder shaft 14 is formed with a longitudinal slot in which a leaf spring 15 is fitted and retained by suitable fasteners such as rivets 16,17, as shown, or alternatively by screws or the like. As desired, the holder shaft 14 may be constructed of two separate components assembled in sandwich-like fashion with the leaf spring 15 disposed therebetween. A shoulder portion 22 extends radially outwardly from the side of the holder shaft 14 facing the rotor 1 in the cleaning disposition of the cleaning device 5.

Figure 2:
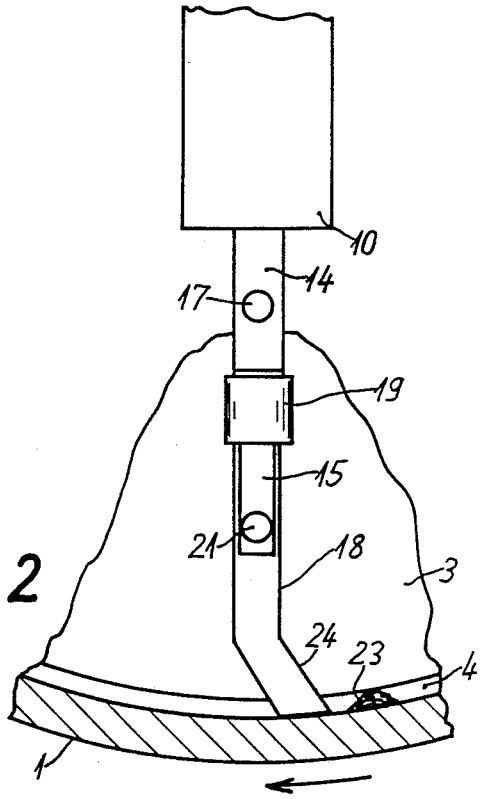
FIG. 2 is a top plan view of the cleaning device of FIG. 1, with the spinning rotor shown in cross-section at its fiber collection groove.

The cleaning device 5 further includes a scraper component 18 which preferably is of an elongate, generally flat, knife-like configuration. One end of the scraper component 18 is formed with a tubular foot portion 19 configured and dimensioned to be slidably fitted onto the rounded end portion of the holder shaft 14 wherein the foot portion 19 encircles the rounded end portion of the holder shaft 14 for relative pivotal movement with respect thereto generally in the nature of a ball-and-socket joint. The opposite end of the scraper component 18 forms a scraping portion 24 which is bent angularly with respect to the longitudinal extent of the holder shaft 14 and the scraper component 18 to extend oppositely to the direction of rotation of the rotor 1, as best seen in FIG. 2. In this manner, the bent end portion 24 of the scraper component 18 presents a forward edge inclined with respect to the direction of rotation of the rotor 1.

The leaf spring 15 affixed to the holder shaft 14 extends generally in alignment with the scraper component 18, the outward end of the leaf spring 15 being formed with a convexly cup-shaped detent portion 21 adapted to releasably receive and retain a detent pin portion 20 projecting outwardly from the scraper component 18. In this manner, the left spring 15 urges the scraper component 18 pivotably toward the bottom wall 3 of the spinning rotor 1 under the biasing force of the leaf spring 15 and, since the cup-shaped detent portion 21 of the leaf spring 15 substantially surrounds the detent pin 20, the leaf spring 15 at the same time prevents the scraper component 18 from disengaging from, or shifting laterally with respect to, the holder shaft 14 during normal cleaning operation of the cleaning device 5, The shoulder 22 formed on the holder shaft 14 acts as a stop to prevent the scraper component 18 from pivoting with respect to the holder shaft 14 to an extent sufficient to disengage the detent pin 20 from the detent portion 21. Of course, as those persons skilled in the art will recognize, other forms of releasable connection between the scraper component 18 and the leaf spring 15 may alternatively be utilized. For example, the scraper component 18 may be provided with a bore or similar opening into which a projecting nose portion of the leaf spring would fit. Thus, the illustrated and described detent connection between the leaf spring 15 and the scraper component 18 is intended merely to be exemplary of one preferred embodiment of releasable connection between these components.

For operation of the cleaning device 5, the spinning unit is initially opened by the cleaning device 5, in a manner not shown in the drawings, in order to expose the spinning rotor 1 for cleaning. Upon opening of the spinning unit, the normal drive for the spinning rotor 1 is disengaged. The arm 6 of the cleaning device 5 then pivots in the direction of the exposed spinning rotor 1 until the friction wheel 8 peripherally engages and comes to rest on the exterior circumference of the spinning rotor 1, as shown in FIG. 1. The electric drive motor 9 to the friction wheel 8 is then energized to drive the friction wheel 8 and, in turn, to drive the spinning rotor 1. Thereupon, compressed air is supplied through the line 12 into the cylinder 10 to actuate movement of the piston 11 within the cylinder 10 against the biasing spring 13 to thereby extend the holder shaft 14 and the scraper component 18 as a unit in the direction of the spinning rotor 1. The bent end portion 24 of the scraper component 18 initially engages the bottom wall 3 of the spinning rotor 1 and, as the movement of the piston 11 continues, subsequently slides along the bottom wall 3 until the bent portion 24 engages in the fiber collection groove 4. In this manner, the bent end portion 24 of the scraper component 18 is positioned to initially engage the interior of the spring rotor 1 at a point deeper therewithin than the fiber collection groove 4 so as to utilize the bottom wall 3 of the rotor 1 as a guide to achieve proper insertion and positioning of the end portion 24 within the groove 4. The operating cylinder 10 may be provided with a pressure monitor (not shown) to permit the forward advance of the scraper component 18 to be stopped when the end portion 24 engages in the groove 4 so as to maintain a predetermined contact pressure of the scraper component 18 within the groove 4.

As desired, the cleaning device 5 may be additionally provided with extensible brushes, suction removal nozzles, blower jets for compressed air, and the like (not shown) in order to enable an optimum cleaning of the interior of the rotor 1 along with the scraping performed by the scraper component 18.

The actual scraping operation of the scraper component 18 for removing debris deposits from the fiber collection groove 4 may best be understood by reference to FIG. 2 which depicts the scraper component 18 and other components of the cleaning device 5 in top plan view. The spinning rotor 1 is shown in radial cross-section at the location of the rotor groove 4 to illustrate the engagement of the bent end portion 24 of the scraper component 18 therein. As in FIG. 1, the holder shaft 14 and the scraper component 18 are extended as a unit from the cylinder 10 with the scraper component being pivoted by its tubular foot portion 19 with respect to the rounded end portion of the holder shaft 14 and pressed by the biasing force of the leaf spring 15 into the rotor groove 4. A deposit of accumulated debris in the rotor groove 4 is representatively depicted at 23. The direction of rotation of the spinning rotor 1 is indicated by the directional arrow, by which the debris accumulation 23 is brought into engagement against the reversely bent end portion 24 of the scraper component 18. As a result of its hook-like bent configuration which somewhat resembles a plow, the forward edge or tip of the end portion 24 penetrates beneath the accumulated debris 23 to effectively break up and scrape out of the groove 4 even hardened baked-on debris accumulations. As a result, an optimal cleaning of the fiber collection groove 4 is possible, even if stubborn and adhesive baked-on debris is present. In contrast, a resiliently mounted scraper component of the type known in the prior art would yield to such debris accumulations and slide thereover without removing hardened, baked-on or adhering debris accumulations. Due to the reverse bend in the end portion 24 of the scraping component 18 to extend in the direction opposite the rotation of the rotor 1, a certain degree of wear between the scraper portion 18 and the fiber collection groove 4 of the rotor 1 can be tolerated so long as the bent configuration of the scraper component 18 remains.

At the completion of the cleaning process, the motor 9 is deenergized to stop further rotation of the spinning rotor 1 and the supply of compressed air to the cylinder 10 is relieved to permit the biasing spring 13 to return the piston 11 to its starting position and, in turn, to retract the holder shaft 14 and the scraper component 18 out of the spinning rotor 1. The arm 6 of the cleaning device 5 is then pivoted away from the spinning rotor 1 and the spinning unit is again closed to enable a restart of its normal spinning operation.

In addition to the optimal cleaning performed as above-described, the present cleaning device 5 provides the advantage of enabling the scraper component 18 to be quickly and simply removed from the holder shaft 14 and replaced without requiring the use of any tools. To do so, the leaf spring 15 is merely lifted manually away from the scraper component 18 to disengage the cup-shaped detent portion 21 of the leaf spring 15 from the detent pin portion 20 of the scraper component 18, whereupon the foot portion 19 of the scraper component 18 may be readily drawn off the rounded end portion of the holder shaft 14. A replacement scraper component 18 may then be readily inserted by a quick and simple reversal of such steps. Thus, the cleaning device 5 of the present invention may readily be adapted for cleaning operation on spinning rotors of differing rotor diameters and shapes merely by a simple exchange of one scraper component 18 for another.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A cleaning device for removing debris from an open end spring rotor having a fiber collection groove, said cleaning device comprising a scraper component adapted for insertion into the fiber collection groove of the rotor, said scraper component having an end portion bent to extend oppositely to the direction of rotation of the rotor, said end portion presenting a forward edge inclined to the direction of rotation of the rotor, and a holder movable toward and away from the fiber collection groove of the rotor, said holder having a rounded end portion, said scraper component having a tubular foot portion for encircling mounting on said rounded end portion of said holder for movement of said scraper component with said holder toward and away from the fiber collection groove of the rotor and for pivotal movement of said scraper component relative to said holder.

2. A cleaning device for removing debris from an open end spinning rotor according to claim 1 and characterized further in that said scraper component is pivotable in a plane substantially perpendicular to the fiber collection groove of the rotor.

3. A cleaning device for removing debris from an open end spinning rotor according to claim 1 and characterized further in that said cleaning device includes a leaf spring attached to said holder, said leaf spring and said scraper component having compatible detent means selectively engagable for retaining said scraper component in attachment with said holder and disengagable for removal and replacement of said scraper component.

4. A cleaning device for removing debris from an open end spinning rotor having a fiber collection groove, said cleaning device comprising a holder having a rounded end portion and a scraper component adapted for insertion into the fiber collection groove of the rotor, said scraper component having a tubular foot portion for encircling mounting on said rounded end portion of said holder for pivotal movement relative to said holder.

5. A cleaning device for removing debris from an open end spinning rotor according to claim 4 and characterized further in that said cleaning device includes a leaf spring attached to said holder, said leaf spring and said scraper component having compatible detect means selectively engagable for retaining said scraper component in attachment with said holder and disengagable for removal and replacement of said scraper component.

* * * * *